US008261371B2

(12) United States Patent
Johnston

(10) Patent No.: US 8,261,371 B2
(45) Date of Patent: Sep. 11, 2012

(54) PENDULUM NECKTIE

(75) Inventor: Rory Johnston, Las Vegas, NV (US)

(73) Assignee: Robert L. Posch, Naples, FL (US)

( * ) Notice: Subject to any disclaimer, the term of this patent is extended or adjusted under 35 U.S.C. 154(b) by 641 days.

(21) Appl. No.: 12/203,231

(22) Filed: Sep. 3, 2008

(65) Prior Publication Data

US 2010/0050318 A1 Mar. 4, 2010

(51) Int. Cl.
*A41D 25/00* (2006.01)

(52) U.S. Cl. ..... 2/144

(58) Field of Classification Search ..... 2/144, 145, 2/146, 150, 153, 156, 152.1
See application file for complete search history.

(56) References Cited

U.S. PATENT DOCUMENTS

| | | | | |
|---|---|---|---|---|
| 2,100,870 | A | 11/1937 | Petrie et al. | |
| 2,918,678 | A | 12/1959 | Gouner | |
| 3,264,654 | A * | 8/1966 | Woronowicz et al. | 2/146 |
| D231,959 | S | 7/1974 | Shah | |
| 3,946,444 | A | 3/1976 | Parrilla | |
| 3,959,825 | A | 6/1976 | Hughes | |
| 5,088,119 | A | 2/1992 | Fortier | |
| 5,815,835 | A | 10/1998 | Craddock | |
| 6,205,587 | B1 | 3/2001 | Shiffler | |
| 6,550,650 | B2 | 4/2003 | Fortier | |
| 7,322,049 | B1 | 1/2008 | Kennedy, Jr. et al. | |
| 7,757,306 | B2 * | 7/2010 | Mattioli | 2/144 |

* cited by examiner

*Primary Examiner* — Tejash Patel
(74) *Attorney, Agent, or Firm* — Young Basile

(57) ABSTRACT

A necktie having a wide end portion formed of a material presenting a first pattern and a narrow end portion formed of a material presenting a second, different, contrasting pattern. The necktie is tied around the neck of a user in a fashion such that the narrow end portion emerges from the knot in front of the wide end portion and hangs down freely from the knot in pendulum fashion in front of the wide end portion so as to present a contrasting pattern to the wide end pattern. Alternatively, the necktie may be tied around the neck of a user in a fashion such that the wide end portion emerges from the knot in front of the narrow end portion and hangs down freely from the knot in pendulum fashion behind the wide end portion so that the wide end portion covers the narrow end portion in conventional fashion and the pattern presented by the tie is that of the wide end portion.

6 Claims, 3 Drawing Sheets

PENDULUM NECKTIE

BACKGROUND OF THE INVENTION

This invention relates to neckties and more particularly to a necktie, and a method of tying a necktie, that presents a unique necktie appearance.

The necktie is a perennial staple of any gentlemen's wardrobe. However, in decade after decade the necktie has remained basically without change except for periodic and/or cyclical changes in the width of the tie.

SUMMARY OF THE INVENTION

The invention provides a unique necktie as well as a unique method of providing a unique necktie appearance.

The methodology of the invention comprises providing a necktie having a wide end portion formed of a material presenting a first pattern and a narrow end portion formed of a material presenting a second different contrasting pattern and tying the necktie around the neck of a user in a fashion such that a tie knot is formed at the neck of the user and the narrow end portion emerges from the knot in front of the wide end portion and hangs down freely from the knot in pendulum fashion in front of the wide end portion so as to present a contrasting pattern to the wide end portion.

According to a further feature of the invention methodology, each necktie has a front visual side intended for viewing and a rear underside having a seam, and the necktie is tied around the neck of a user in a manner such that the rear underside of the narrow end portion is juxtaposed and hangs in front of the visual side of the wide end portion so that the front viewing side of the narrow end portion overlies the front viewing side of the wide end portion in pendulum fashion.

According to a further feature of the invention methodology, the narrow portion of the necktie includes a terminal end section and an intermediate section between the terminal end section and the wide end portion, and the step of tying the necktie around the neck of the user comprises positioning the narrow end portion over the wide end portion; looping an intermediate section of the narrow end portion around the wide end portion; and passing a terminal free end section of the narrow end portion between the wide end portion and the intermediate section of the narrow end portion with the free terminal end section of the narrow end portion positioned in front of the wide end portion.

According to a further feature of the invention methodology, the narrow portion of the necktie further includes an initial section proximate the wide end portion and the step of tying the necktie around the neck of the user comprises positioning the narrow end portion over wide end portion to form a loop around the neck of the user; looping the intermediate section of the narrow end portion underneath the wide end portion; bringing the intermediate section of the narrow end portion back over in front of the wide end portion; passing the intermediate section of the narrow end portion up behind and through the loop; passing the terminal end section of the narrow end portion downwardly between the intermediate section of the narrow end portion and the initial section of the narrow end portion to form a tie knot; and moving the knot upwardly to the neck by holding die wide end portion and sliding the knot up.

According to a further feature of the invention methodology, the method includes the further step of tying the necktie around the neck of the user in an alternate manner such that the rear underside of the wide end portion hangs in front of the front visual side of the narrow end portion so that the wide end portion covers the narrow end portion.

The invention also discloses a method of providing a plurality of appearances from a single necktie. According to this methodology, a necktie is provided having a wide end portion formed of material presenting a first pattern and a narrow end portion formed of a material presenting a second, different, contrasting pattern, and the tie is selectively tied around the neck of a user in a first manner such that a tie knot is formed at the neck of a user and the narrow end portion emerges from the knot in front of the wide end portion and hangs down freely from the knot in pendulum fashion in front of the wide end portion so as to present a contrasting pattern to the wide end pattern and in a second manner such that the wide end portion emerges from the knot in front of the narrow end portion and hangs down freely from the knot in pendulum fashion in front of the narrow end portion so as to cover the narrow end portion The necktie of the invention includes a narrow end portion having a front visual side presenting a first pattern and a wide end portion having a front visual side presenting a second, contrasting pattern and is characterized in that the necktie is configured to define a loop for positioning around the neck of the user and a knot for positioning against the neck of the user with the narrow end portion emerging from the knot in front of the wide end portion and hanging freely down from the knot in pendulum fashion in front of the wide end portion so as to present a contrasting pattern to the wide end portion.

According to a further feature of the invention necktie, each necktie portion has a rear underside having a seam and, with the loop positioned around the neck of the user, the rear underside of the narrow end portion is juxtaposed and hangs in front of the front visual side of the wide end portion so that the front viewing side of the narrow end portion overlies the front viewing side of the wide end portion in pendulum fashion Other objects, advantages, and applications of the present invention will become apparent to those skilled in the art when the following description of the best mode contemplated for practicing the invention is read in conjunction with the accompanying drawings.

DETAILED DESCRIPTION OF THE PREFERRED EMBODIMENT

Figure 1:
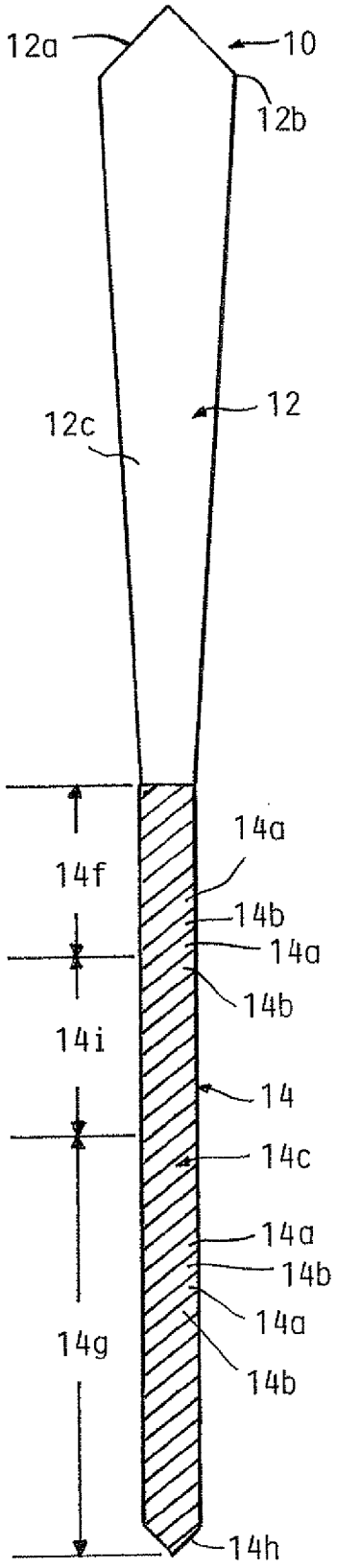
FIG. 1 is a view showing the front visual side of a necktie according to the invention.
Figure 2:
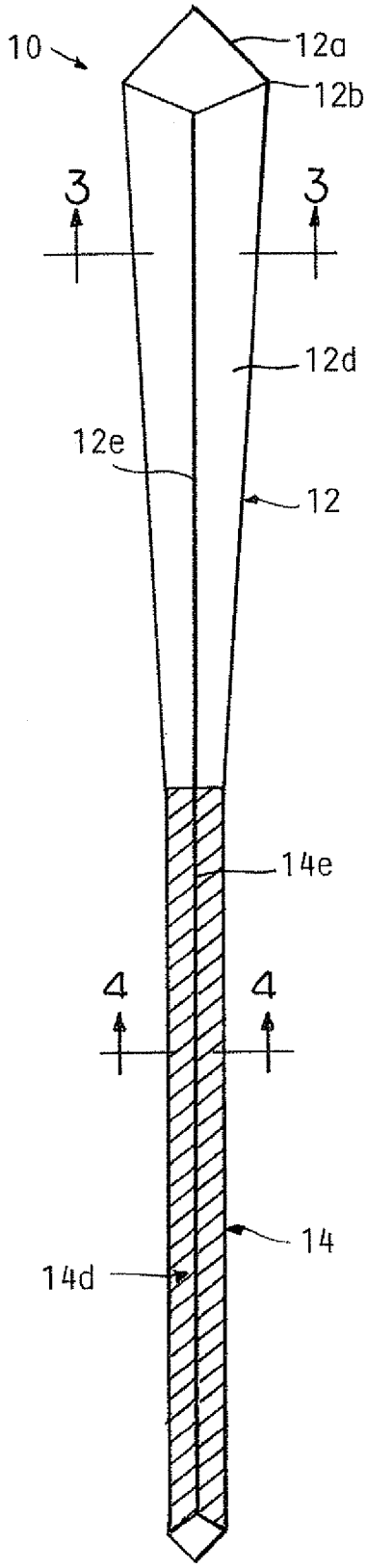
FIG. 2 is a view showing the rear underside of the invention necktie.
Figure 3:
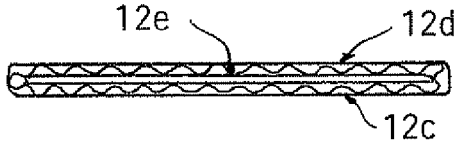
FIGS. 3 and 4 are cross-sectional views taken on lines 3-3 and 4-4 of FIG. 2.
Figure 4:
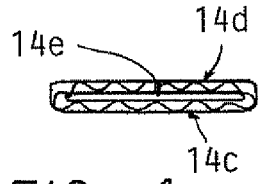

A necktie 10 seen in FIGS. 1 and 2 includes a wide end portion 12 and a narrow end portion 14. The portions 12 and 14 may each be approximately equal in length so that for a 66 inch long necktie, each portion is 33 inches long. Wide end portion 12 may have a tapered configuration terminating in a pointed end 12*a* and may have maximum width at 12*b* proximate the pointed end 12*a* of 3 inches. Narrow end portion 14 may have an essentially uniform width of 1.25 inches. Wide end portion 12 is formed of a first pattern and narrow end portion 14 is formed of a second, different contrasting pattern. For example, as shown, wide end portion 12 may have a solid color pattern such as navy blue, and narrow end portion 14 may have a striped pattern such as diagonal navy blue stripes 14*a* on a gold background 14*b*.

Pattern, as used herein, includes not only the presence of markings and/or colors, but also the absence of both markings and colors. For example, a pattern can include a paisley design, diagonal stripes, and any single solid color. A pattern can also include the absence of any additional markings or colors to the fabric or the material of the tie.

Wide end portion 12 includes a front visual side 12*b* and a rear visual side 12*c* including a seam 12*b*.

Narrow end portion 14 includes a front visual side 14*c* and a rear visual side 14*d* including a seam 14*e*.

For purposes of explaining the manner in which the necktie is tied around the neck of a user, narrow end portion 14 may further be considered to have an initial section 14*f* adjoining the wide end portion 12, a terminal or tail end section 14*g* terminating in a pointed end 14*h*, and an intermediate section 14*i* between initial section 14*f* and terminal end section 14*g*

The invention necktie is tied around the neck of a user in the sequential manner illustrated in FIGS. 5-10 where 16 represents the collar of a shirt worn by the user.

Figure 5:
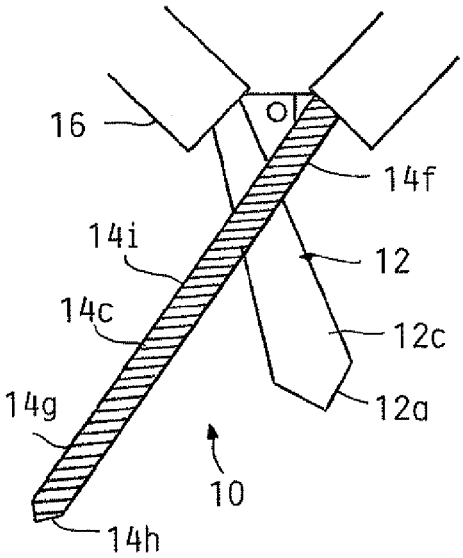
FIGS. 5-10 are sequential views showing one manner in which the invention necktie is tied around the neck of a user.
Figure 6:
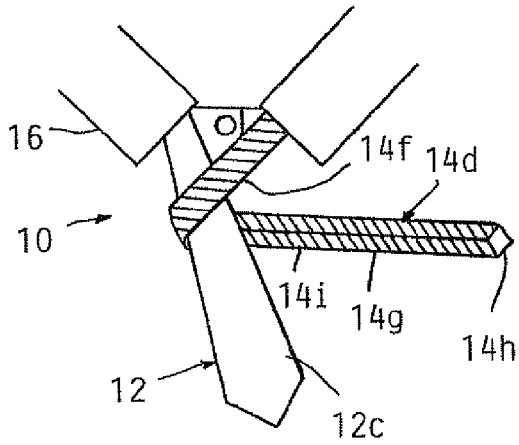
Figure 7:
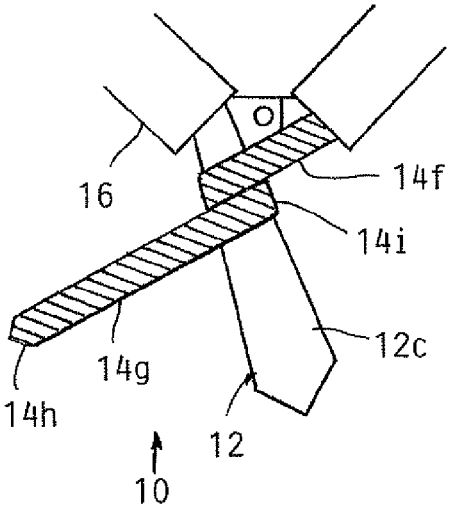
Figure 8:
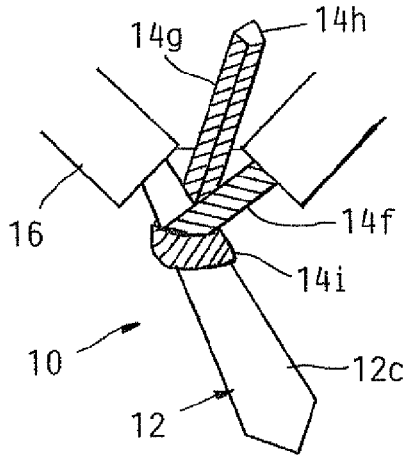
Figure 9:
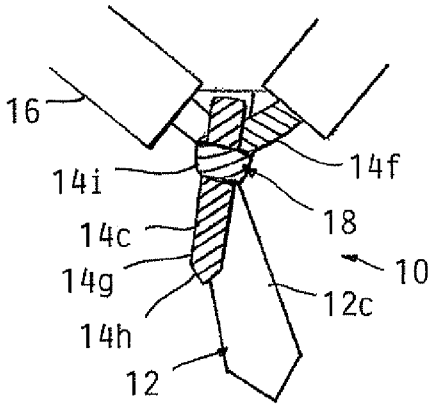
Figure 10:
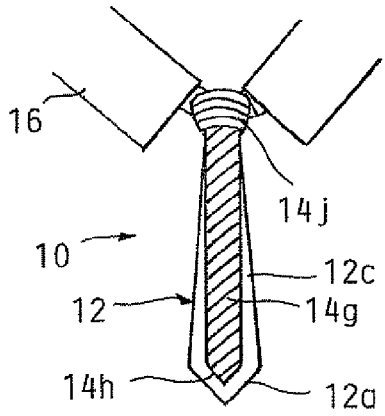

As seen in FIG. 5, necktie 10 is positioned around the neck of the user beneath collar 16 with the visual side 14*c* of the narrow end portion 14 positioned over the visual side 12*c* of the wide end portion 12 to form a loop with the narrow end portion extending below the wide end portion whereafter, as seen in FIG. 6, the intermediate section 14*i* of the narrow end portion is passed underneath the wide end portion 14, whereafter, as seen in FIG. 7, the intermediate section 14*i* of the narrow end portion is brought back over in front of the wide end portion, whereafter, as seen in FIG. 8, the terminal end 14*g* of the narrow end portion is passed upwardly behind the wide end portion and through the loop formed at the neck of the user whereafter, as seen in FIG. 9, the terminal end section of the narrow end portion is passed downwardly between the intermediate section 14*i* of the narrow end portion and the initial section 14*f* of the narrow end portion to form a tie knot 18 whereafter, as seen in FIG. 10, the tie knot 18 is moved upwardly to the neck of the user by holding the wide end portion and sliding the knot up.

Figure 11:
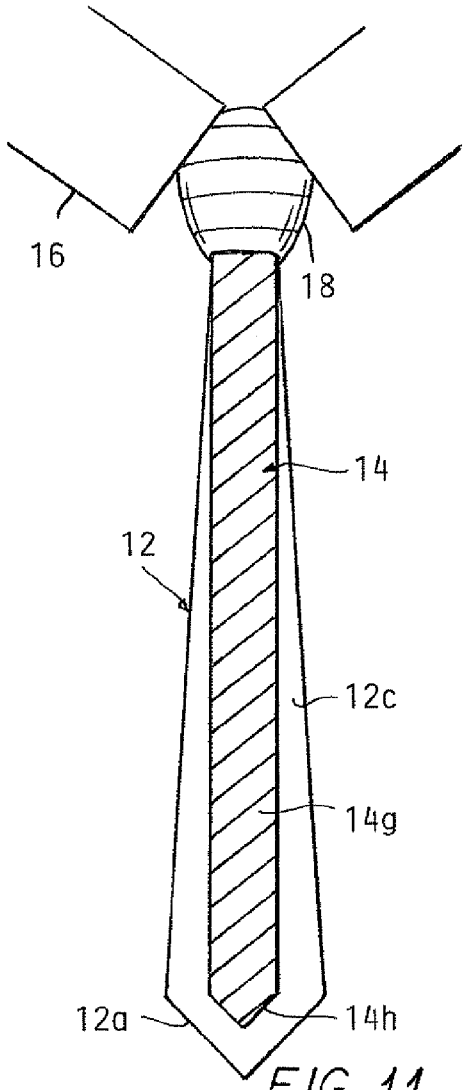
FIG. 11 is a view showing the invention necktie tied in accordance with the sequence of FIGS. 5-10.

This results in the unique necktie appearance seen in FIGS. 10 and 11 wherein the terminal end section 14*g* of the narrow end portion emerges from the knot 18 in front of the wide end portion 14 and hangs down freely from the knot in pendulum fashion in front of the wide end portion so as to present a contrasting pattern to the wide end pattern, in this case a diagonally striped pattern contrasting with the solid pattern of the wide end portion. Specifically, the rear underside of the narrow end portion is juxtaposed and hangs in front of the visual side of the wide end portion so that the front visual side of the narrow end portion overlies the front visual side of the wide end portion in pendulum fashion.

The tie may be adjusted such that, as shown, the pointed end 14*h* of the narrow end portion is spaced slightly above the pointed end 12*a* of the wide end portion. Alternatively, the tie may be adjusted such that the pointed end 14*h* coincides with pointed end 12*a*, is spaced significantly above pointed end 12*a*, or hangs below pointed end 12*a*. Whereas at first the necktie may appear to be a normal tie with a printed pattern, as the user moves the narrow end portion shifts in pendulum fashion relative to the wide end portion to provide a striking, eye-catching necktie appearance.

The invention tie would of course come in a variety of widths and a multitude of patterns and colors and might, for example, be provided in a college edition with the colors of the college represented in the contrasting patterns of the narrow end portion and wide end portions.

Figure 12:
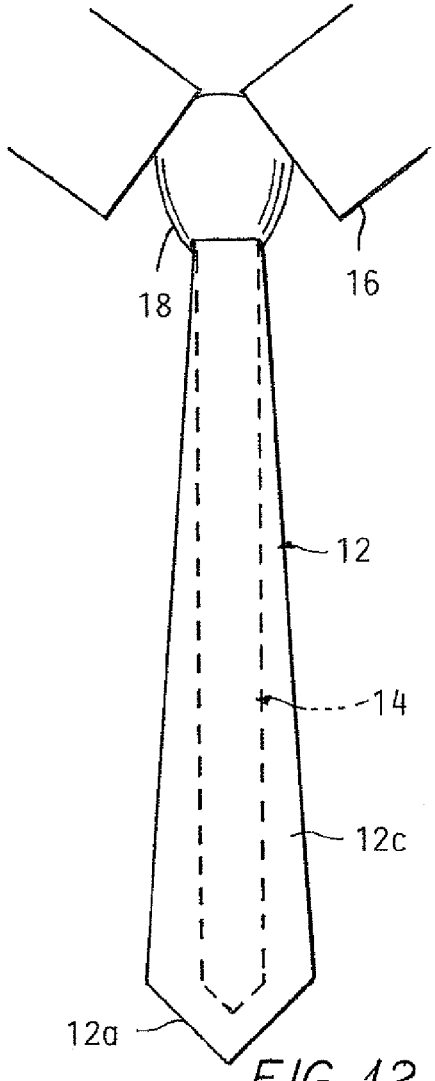
FIG. 12 is a view showing the invention necktie tied in an alternate manner.

Further, as seen in FIG. 12, the invention tie may be tied in a manner that is essentially the reverse of the sequence illustrated in FIGS. 5-10 such that the wide end portion 12 emerges from the knot 18 on top of the narrow end portion so that the narrow end portion is hidden by the wide end portion and the tie presents a conventional appearance. The FIG. 12 appearance may of course be achieved by tying the tie in any fashion such that the wide end portion 12 emerges from the knot in front of the narrow end portion and thereby hides the narrow end portion in conventional fashion.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A method of providing a unique necktie appearance comprising:

providing a single piece necktie consisting of a single elongated continuous piece of fabric having a wide end portion formed of a material presenting a first pattern and a narrow end portion formed of a material providing a second, different contrasting pattern; and tying the necktie around the neck of a user in a fashion such that a knot is formed at the neck of the user and the narrow end portion emerges from the knot in front of the wide end portion and hangs down freely from the knot in pendulum fashion immediately in front of and directly overlying the wide end portion without any fabric therebetween so as to present a contrasting pattern directly overlying the wide end pattern portion.

2. A method according to claim 1 wherein:

each necktie has a front visual side intended for viewing and a rear underside having a seam; and the necktie is tied around the neck of a user in a manner such that the rear underside of the narrow end portion is juxtaposed and hangs in front of the visual side of the wide end portion so that the front visual side of the narrow end portion overlies the front visual side of the wide end portion in pendulum fashion.

3. A method according to claim 1 wherein the narrow portion of the necktie includes a terminal end section and an intermediate section between the terminal end section and the wide end portion and the step of tying the necktie around the neck of the user comprises:

positioning the narrow end portion over the wide end portion;

looping the immediate section of the narrow end portion around the wide end portion; and passing the terminal free end section of the narrow end portion between the wide end portion and the intermediate section of the narrow end portion with the free end terminal section of the narrow end portion positioned in front of the wide end portion.

4. A method according to claim 1 wherein the narrow end portion of the necktie includes an initial section proximate the wide end portion, a terminal end section, and an intermediate section between the initial section and the terminal end section, and the step of tying the necktie around the neck of the user comprises:

with a necktie looped around the neck of the user, positioning the narrow end portion over the wide end portion to form a loop around the neck of the user;

looping the intermediate section of the narrow end portion underneath the wide end portion;

bringing the intermediate section of the narrow end portion back over in front of the wide end portion;

passing the intermediate section of the narrow end portion up behind and through the loop;

passing the terminal end section of the narrow end portion downwardly between the intermediate section of the narrow end portion and the initial section of the narrow end portion to form a tie knot; and moving the knot upwardly to the neck by holding the wide end portion and sliding the knot up.

5. A method according to claim 2 including the further step of tying the necktie around the neck of the user in an alternate manner such that the rear underside of the wide end portion hangs in front of the front visual side of the narrow end portion so that the wide end portion covers the narrow end portion.

6. A method of providing a plurality of appearances from a single piece necktie consisting of a single elongated continuous piece of fabric having a wide end portion and a narrow end portion, the method comprising:

forming the wide end portion of a material providing a first pattern;

forming the narrow end portion of the material presenting a second, different, contrasting pattern; and selectively tying the necktie around the neck of a user in a first manner such that a tie knot is formed at the neck of the user and the narrow end portion emerges from the knot in front of the wide end portion and hangs down freely from the knot in pendulum fashion immediately in front of and directly overlying the wide end portion without any fabric therebetween so as to present a contrasting pattern directly overlying the wide end portion and tying the necktie around the neck of a user in a second manner such that the wide end portion emerges from the knot in front of the narrow end portion so that the wide end portion covers the narrow end portion.

* * * * *